US009694260B1

(12) United States Patent
Abbott et al.

(10) Patent No.: US 9,694,260 B1
(45) Date of Patent: Jul. 4, 2017

(54) PUTTERS WITH VARIABLE FACE THICKNESS AND ADJUSTABILITY FEATURES

(71) Applicant: CALLAWAY GOLF COMPANY, Carlsbad, CA (US)

(72) Inventors: Craig E. Abbott, Vista, CA (US); Wee Joung Kim, Vista, CA (US); Kevin P. Dacey, La Jolla, CA (US); Bradley C. Rice, Carlsbad, CA (US); Brandon D. DeMille, Carlsbad, CA (US); Esteban Aguilar, Carlsbad, CA (US); Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 80 days.

(21) Appl. No.: 14/828,101

(22) Filed: Aug. 17, 2015

Related U.S. Application Data

(60) Provisional application No. 62/048,094, filed on Sep. 9, 2014.

(51) Int. Cl.
*A63B 53/04* (2015.01)
*A63B 53/06* (2015.01)
*A63B 53/00* (2015.01)

(52) U.S. Cl.
CPC ..... *A63B 53/0487* (2013.01); *A63B 53/007* (2013.01); *A63B 53/065* (2013.01); *A63B 2053/0445* (2013.01); *A63B 2053/0458* (2013.01); *A63B 2053/0491* (2013.01)

(58) Field of Classification Search
CPC . A63B 53/0587; A63B 53/065; A63B 53/007; A63B 2053/0491; A63B 2053/0445; A63B 2053/0458
USPC ..... 473/331, 334–341, 330; D21/750–751
See application file for complete search history.

(56) References Cited

U.S. PATENT DOCUMENTS 5,275,412 A * 1/1994 Innes ..... A63B 69/3685 473/253
5,470,068 A * 11/1995 Schmidt ..... A63B 53/04 473/311
D415,808 S * 10/1999 Helmstetter ..... D21/759
D425,159 S * 5/2000 Helmstetter ..... D21/759
D443,323 S * 6/2001 Solheim ..... D21/759
6,348,014 B1 * 2/2002 Chiu ..... A63B 53/065 473/337
6,443,856 B1 * 9/2002 Galloway ..... A63B 53/04 473/330
6,699,140 B1 * 3/2004 Sun ..... A63B 53/0487 473/252
7,163,468 B2 * 1/2007 Gibbs ..... A63B 53/0466 473/329
D554,214 S * 10/2007 Chen ..... D21/759
7,491,131 B2 * 2/2009 Vinton ..... A63B 53/0487 473/251

(Continued)

*Primary Examiner* — Sebastiano Passaniti
(74) *Attorney, Agent, or Firm* — Rebecca Hanovice; Michael Catania; Sonia Lari

(57) ABSTRACT

A putter head having variable face thickness or multiple materials and adjustable weighting features is disclosed herein. The variable face thickness may comprise a plurality of geometric shapes on the striking face surface with spacing between them that decreases in a top to bottom direction, or the face may include a plurality of angled carbon rods. The putter also includes an adjustable weight cartridge that can pivot in a toe-heel direction.

4 Claims, 6 Drawing Sheets

(56) References Cited

U.S. PATENT DOCUMENTS 7,993,216 B2 * 8/2011 Lee ..... A63B 53/0466 473/334
8,337,324 B2 * 12/2012 Sander ..... A63B 53/047 473/330
8,403,771 B1 * 3/2013 Rice ..... A63B 53/04 473/328
8,529,368 B2 * 9/2013 Rice ..... A63B 53/04 473/329
D722,350 S * 2/2015 Schweigert ..... D21/735
9,144,725 B2 * 9/2015 Hocknell ..... A63B 53/04
9,265,996 B1 * 2/2016 Abbott ..... A63B 53/0466
D764,613 S * 8/2016 Noyes ..... D21/759
9,498,685 B2 * 11/2016 Abbott ..... A63B 53/0487
9,504,885 B2 * 11/2016 Ban ..... A63B 53/0466
9,555,300 B2 * 1/2017 Abbott ..... A63B 53/0466
9,566,484 B1 * 2/2017 Abbott ..... A63B 53/0487
2002/0065143 A1 * 5/2002 Shin ..... A63B 53/04 473/330
2003/0153399 A1 * 8/2003 Woodward ..... A63B 53/04 473/331
2004/0009829 A1 * 1/2004 Kapilow ..... A63B 53/04 473/342
2006/0154739 A1 * 7/2006 Mann, Jr. ..... A63B 53/04 473/330
2009/0131197 A1 * 5/2009 Miyamichi ..... A63B 53/0487 473/329
2009/0286621 A1 * 11/2009 Franklin ..... A63B 53/0466 473/340
2010/0009771 A1 * 1/2010 Newcomer ..... A63B 53/0466 473/327
2012/0071269 A1 * 3/2012 Rahrig ..... A63B 53/047 473/331
2013/0157776 A1 * 6/2013 Serrano ..... A63B 53/04 473/331
2013/0165252 A1 * 6/2013 Rice ..... A63B 53/04 473/329
2013/0165254 A1 * 6/2013 Rice ..... A63B 53/0466 473/329
2014/0274452 A1 * 9/2014 Oldknow ..... A63B 53/047 473/331
2016/0008677 A1 * 1/2016 Kitagawa ..... A63B 53/0466 473/331

* cited by examiner

PUTTERS WITH VARIABLE FACE THICKNESS AND ADJUSTABILITY FEATURES

CROSS REFERENCES TO RELATED APPLICATIONS

The present application claims priority to U.S. Provisional Patent Application No. 62/048,094, filed on Sep. 9, 2014, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a putter that has varying thickness patterns on its face to optimize performance and control of golf balls, as well as adjustability features to allow for greater ball spin control.

Description of the Related Art

The prior art discloses many different types of putters with face inserts designed to provide the desired feel and performance. The problem with the prior art lies in the fact that these putter faces have constant thickness throughout the entirety of the face, which limits the control a golfer has over a golf ball during play. Putters also can benefit from having adjustable weighting. Therefore, there is a need for putters with variable face thickness and adjustable weighting technology.

BRIEF SUMMARY OF THE INVENTION

One aspect of the present invention is a putter comprising an integrally formed face or face insert with variable face thickness, the face having a smallest thickness at its periphery and a greatest thickness proximate its center. Another aspect of the present invention is a putter comprising an integrally formed face or face insert comprising a plurality of geometric shapes that are spaced from one another at different distances across the face to affect top spin. Yet another aspect of the present invention is a putter comprising a face insert composed of a plurality of angled, lightweight rods. Another aspect of the present invention is a putter comprising a face insert connected to a body by a hinge. Yet another aspect of the present invention is a putter comprising a sole groove or slot and a hollow interior that is either empty or at least partially filled with a low density material. Still other aspects of the present invention are putters with adjustable weight cartridges disposed in an interior cavity, and putters with multiple locations to receive detachable weights.

Another aspect of the present invention is a putter comprising a body comprising a top portion, a bottom portion, a heel side, a toe side, and a hosel, a face component comprising a striking surface and a variable thickness pattern, and at least one adjustable weight feature. In some embodiments, the variable thickness pattern may comprise a center region with a maximum thickness and a peripheral region with a minimum thickness. In a further embodiment, the body may comprise a hollow region disposed behind the face component, which may be at least partially filled with a foam material. In another embodiment, the variable thickness pattern may comprise a plurality of geometric shapes disposed across the striking surface, and the distance between each pair of geometric shapes may decrease in a top-to-bottom direction. In a further embodiment, each of the geometric shapes may be an oval. In another embodiment, the face component may be a face insert.

In another embodiment, the variable thickness pattern may comprise a plurality of geometric shapes that extend across less than two thirds of a total area of the striking face. In a further embodiment, each of the geometric shapes may be a circle, and each circle may be an indentation extending into the striking face. In another embodiment, the at least one adjustable weight feature may be selected from the group consisting of an adjustable weight cartridge and a plurality of weight screws. In a further embodiment, the bottom portion may extend rearwards away from the face and comprise a plurality of through holes, the adjustable weight feature may be a plurality of weights, and each of the plurality of weights may be sized to fit within at least one of the plurality of through holes.

Yet another aspect of the present invention is a putter comprising a body comprising a top portion, a bottom portion, a heel side, a toe side, a front recess, and a hosel, a face insert comprising a striking surface, a rear surface, plurality of carbon rods and a secondary material, wherein the face insert is sized to fit within the front recess, wherein the secondary material is different from the material of the carbon rods, and wherein each of the plurality of carbon rods is angled with respect to a horizontal plane perpendicular with the striking surface. In some embodiments, each of the plurality of carbon rods may be angled downwards with respect to the horizontal plane. In other embodiments, each of the plurality of carbon rods may be angled at 45 degrees with respect to the horizontal plane. In some embodiments, the secondary material may comprise urethane. In yet other embodiments, the angles of the carbon rods with respect to the horizontal plane may vary across the face insert.

Another aspect of the present invention is a putter comprising a body comprising a top portion, a bottom portion, a heel side, a toe side, a front portion, a hinge location, and a hosel, and a face component comprising a top edge, a bottom edge, a heel edge, and a toe edge, wherein the top edge of the face component is affixed to the hinge location, and wherein no other edge of the face component is affixed to the body. In some embodiments, the putter may further comprise a polymeric material, which may be disposed between at least a portion of the front portion of the body and the face component.

Another aspect of the present invention is a putter comprising a body with a hollow cavity and a deep slot that extends into the cavity.

Yet another aspect of the present invention is a putter comprising a body comprising a top portion, a bottom portion, and a face portion, and an adjustable weight cartridge comprising a heavy end, a lightweight end, a first through hole disposed in the heavy end, and a second through hole disposed in the lightweight end, wherein the bottom portion extends rearwards from the face portion at least one inch, wherein a pin extends upwards from a rear portion of the bottom portion, and wherein each of the first and second through holes is sized to receive the pin and allow the adjustable weight cartridge to rotate in a heel-to-toe direction around the pin. In some embodiments, when the pin is engaged with one of the first and second through holes, the opposite end of the adjustable weight cartridge may be disposed proximate a rear surface of the face portion. In a further embodiment, the opposite end of the adjustable weight cartridge may make contact with a rear surface of the face portion. In another embodiment, the body may further comprise a support structure, and at least one end of the adjustable weight cartridge may be capable of making contact with the support structure when the pin is engaged with one of the first and second through holes. In another embodiment, when the pin is engaged with one of the first and second through holes, the adjustable weight cartridge has a longitudinal axis that may be angled with respect to a ground plane.

Another aspect of the present invention is a putter comprising a body comprising a top portion, a bottom portion, a heel side, a toe side, and a hosel, a face component comprising a striking surface and a variable thickness pattern, and at least one adjustable weight feature, wherein the variable thickness pattern comprises a plurality of geometric shapes disposed on the striking surface, and wherein spacing between each pair of geometric shapes at a location on the striking surface proximate the top portion is greater than spacing between each pair of geometric shapes at a location on the striking surface proximate the bottom portion. The body may comprise a hollow region disposed behind the face component, which may be at least partially filled with a foam material. The plurality of geometric shapes, each of which may be circles, may be disposed on less than two thirds of a total surface area of the striking face, and may be indentations extending into the striking face. The at least one adjustable weight feature may be selected from the group consisting of an adjustable weight cartridge and a plurality of weight screws, and in some embodiments, the bottom portion may extend rearwards away from the face and comprise a plurality of through holes, the adjustable weight feature may be a plurality of weight screws, and each of the plurality of weight screws may be sized to at least partially fit within at least one of the plurality of through holes. In a further embodiment, the plurality of through holes may comprise at least ten through holes. In another embodiment, the bottom portion may be at least partially composed of a metal material, and the through holes may be evenly spaced from one another across the bottom portion.

Yet another aspect of the present invention is a putter comprising a body comprising a top portion, a bottom portion, a heel side, a toe side, a front recess, and a hosel, a face insert comprising a striking surface, a rear surface, a plurality of carbon rods, and a secondary material, wherein the face insert is sized to fit within the front recess, wherein the secondary material is different from the material of the carbon rods, wherein each of the plurality of carbon rods has a first end proximate the striking surface and a second end proximate a rear surface opposite the striking surface, and wherein each of the plurality of carbon rods is angled with respect to a horizontal plane extending perpendicular to the striking surface. In some embodiments, the first end of each of the plurality of carbon rods may be closer to the bottom portion than the second end of each of the plurality of carbon rods, and each of the plurality of carbon rods may be angled at 45 degrees with respect to the horizontal plane. In an alternative embodiment, the plurality of carbon rods may comprise a first set of carbon rods and a second set of carbon rods, the first set of carbon rods may be disposed at a first angle, such as 45 degrees, with respect to the horizontal plane, the second set of carbon rods may be disposed at a second angle with respect to the horizontal plane, and the first angle may be different from the second angle. In some embodiments, the secondary material may comprise urethane.

Another aspect of the present invention is a putter comprising a body comprising a top portion, a bottom portion, and a face portion, and an adjustable weight cartridge comprising a heavy end, a lightweight end, a first through hole disposed in the heavy end, and a second through hole disposed in the lightweight end, wherein the bottom portion extends rearwards from the face portion at least one inch, wherein a pin extends upwards from a rear portion of the bottom portion, and wherein each of the first and second through holes is sized to receive the pin and allow the adjustable weight cartridge to rotate in a heel-to-toe direction around the pin. In some embodiments, when the pin is engaged with one of the first and second through holes, the opposite end of the adjustable weight cartridge may be disposed proximate a rear surface of the face portion. In a further embodiment, the opposite end of the adjustable weight cartridge may make contact with a rear surface of the face portion. In another embodiment, the body may comprise a support structure, and at least one end of the adjustable weight cartridge may be capable of making contact with the support structure when the pin is engaged with one of the first and second through holes. In yet another embodiment, when the pin is engaged with one of the first and second through holes, the adjustable weight cartridge may have a longitudinal axis that is angled with respect to a horizontal ground plane.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a putter having a face with variable thickness patterns or other features that affect the spin of a golf ball off the face, and adjustable center of gravity and spin control features.

Figure 1:
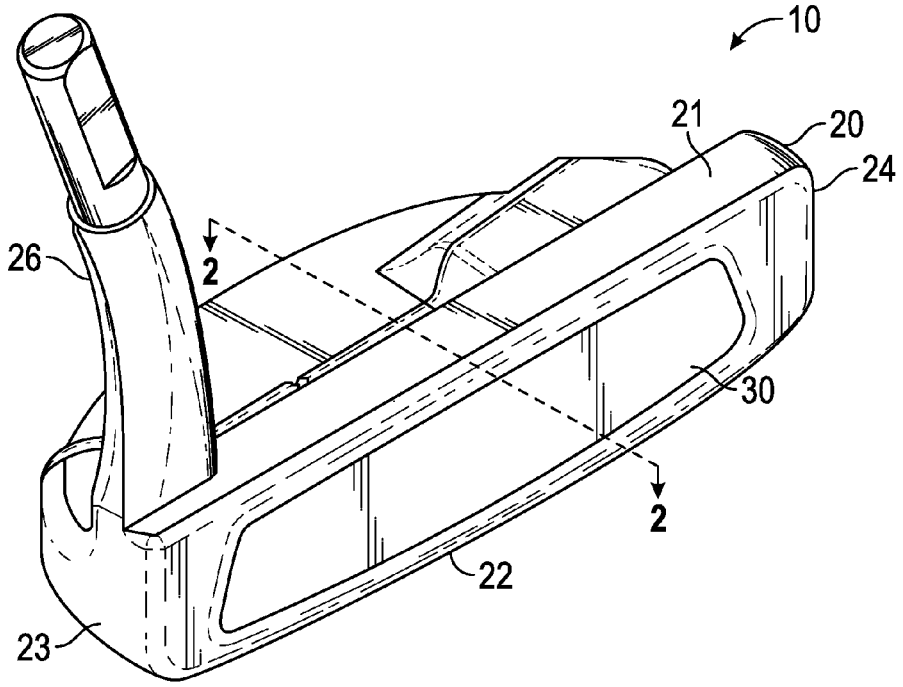
FIG. 1 is a front perspective view of a putter head with a face insert according to a first embodiment of the present invention.
Figure 2:
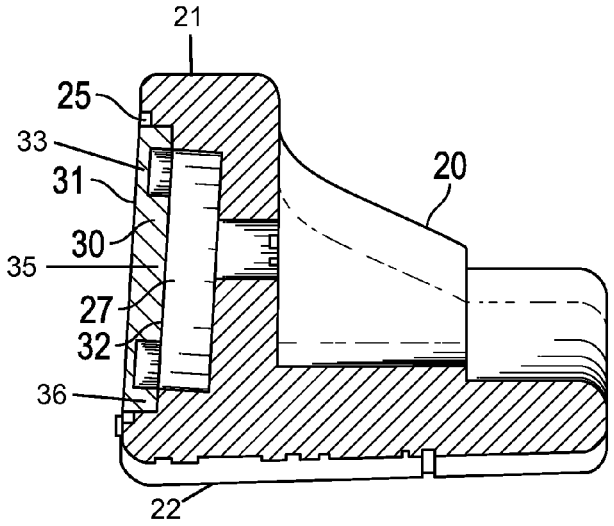
FIG. 2 is a cross-sectional view of the putter head shown in FIG. 1 along lines 2-2.
Figure 3:
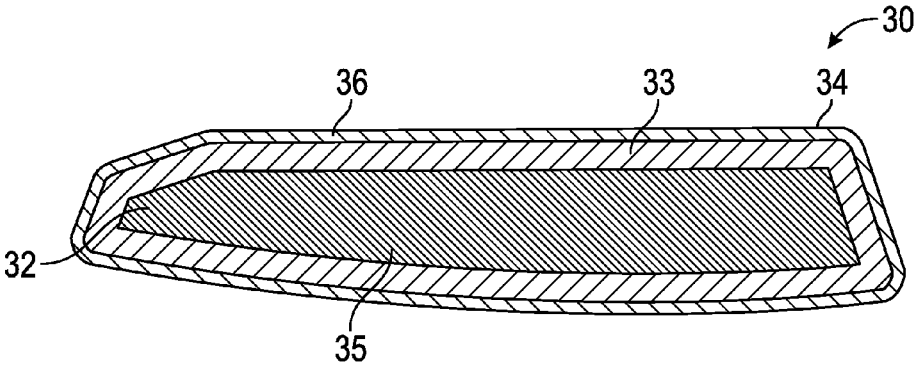
FIG. 3 is a rear plan view of the face insert shown in FIG. 1.

As shown in FIGS. 1-3, in a first embodiment, the putter head 10 comprises a body 20 comprising a top portion 21, bottom portion 22, heel portion 23, toe portion 24, hosel 26, and frontal recess 25, and a face insert 30 sized to fit within the frontal recess 25 such that the frontal recess 25 is sealed off from outside debris. The face insert 30 may be bonded or welded to the body 20, depending on the material composition of the face insert 30. In this embodiment, a hollow region 27 preferably is disposed between a back surface 32 of the face insert 30 and the body 20, though in another embodiment it may be filled by a low-density material such as foam. The hollow region 27 acts as a sound chamber to improve the sound of a golf ball making contact with the face insert 30.

As shown in these Figures, and particularly FIGS. 2 and 3, the face insert 30 has a striking surface 31, a back surface 32, and a variable thickness pattern that includes a thin region 33 proximate a peripheral edge 34, a first thicker region 35 at the center of the face insert 30, and a second thicker region 36 at the peripheral edge 34. The first and second thicker regions 35, 36 preferably have the same thickness, as illustrated in FIG. 2, but in an alternative embodiment may have different thicknesses, as long as they are both thicker than the thin region 33.

Figure 4:
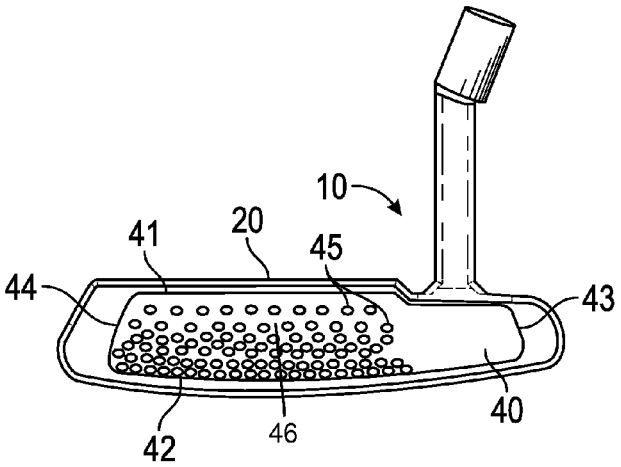
FIG. 4 is a front plan view of a putter head with a face insert according to a second embodiment of the present invention.

As shown in FIG. 4, in a second, preferred embodiment, the putter head 10 comprises a body 20 with the same features as disclosed in connection with the first embodiment herein, and a face insert 40 with a top edge 41, a bottom edge 42, a heel edge 43, a toe edge 44, a striking surface 46, and a plurality of geometric shapes, in this embodiment ovals 45, distributed across the striking surface 46. The ovals 45 have different spacing between one another depending on their location on the face insert 40. As shown in FIG. 4, adjacent ovals 45 located closer to the top edge 41 of the face insert 40 are spaced further apart from one another than adjacent ovals 45 located closer to the bottom edge 42 of the face insert 40. The distance between ovals 45 gradually decreases from the top edge 41 to the bottom edge 42, and this pattern varies the thickness of the face insert 40 in a vertical direction and improves top spin of golf balls leaving the striking surface 46. In other embodiments, the face insert 40 may include shapes such as be triangles, squares, rectangles, circles, rhombuses, and/or any other geometric shape known to a person skilled in the art other than ovals 45. The shapes are preferably milled into the face insert 40 if the face insert 40 is composed of a metallic material, but in other embodiments may be cast, forged, or electric discharge machined into the face insert 40. If the face insert 40 is composed of a polymeric material, such as urethane, then the shapes may be molded or milled into the face insert 40.

Figure 5:
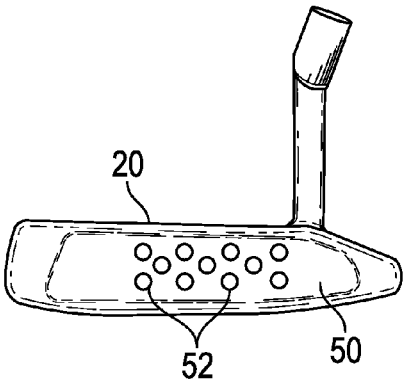
FIG. 5 is a front plan view of a putter head with an integrally formed face according to a third embodiment of the present invention.
Figure 6:
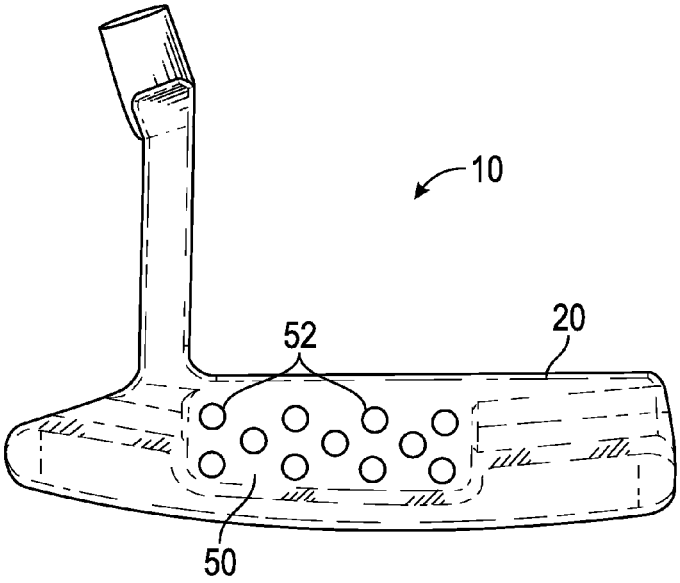
FIG. 6 is a rear plan view of the putter head shown in FIG. 5.

As shown in FIGS. 5-6, in a third, alternative embodiment to the preferred embodiment, the putter head 10 has a body with the same features as those disclosed in connection with the first and second embodiments, but its face 50 is integrally formed with the body 20 such that the putter head 10 is a single piece. In this embodiment, the face 50 comprises a plurality of circles 52 that are evenly spaced from one another across a selected portion, but not the entirety, of the face 50. The area of the face that includes these circles 52 is selected to optimize the sound and feel of the putter head 10 during use, and preferably is less than two thirds of the face 50 overall area. As shown in these Figures, the circles 52 may be through-bores that extend completely through the face 50, but preferably are indentations or filled holes that adjust the thickness of the face 50 in the one or more regions of the face 50 where they are located. The circles 52 can be created using any of the techniques described herein or known to a person skilled in the art.

Figure 7:
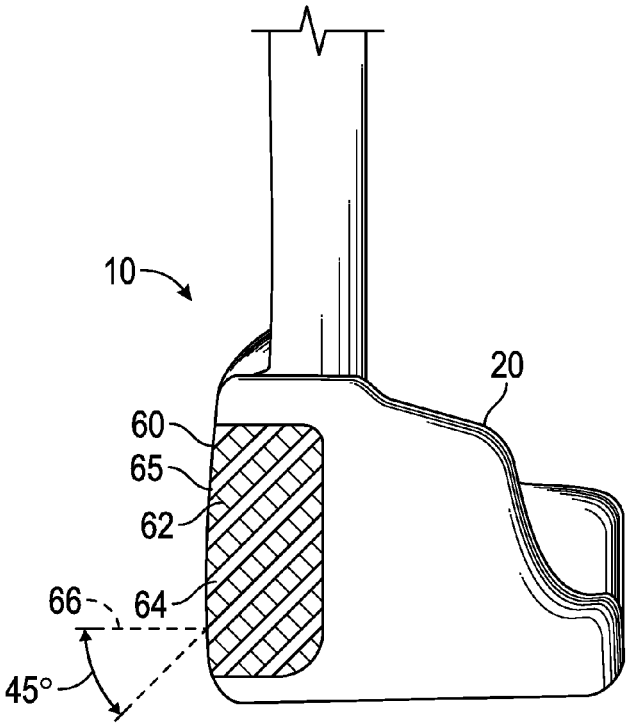
FIG. 7 is a cross-sectional view of a putter head with a face insert according to a fourth embodiment of the present invention.

As shown in FIG. 7, in a fourth embodiment of the present invention, the putter head 10 has a body 20 with the same features as disclosed in connection with the first embodiment herein, and a face insert 60 composed of a plurality of carbon rods 62 embedded in a different, secondary material 64, preferably urethane or another polymeric material. The carbon rods 62 preferably are angled downward within the secondary material 64 with respect to a plane 66 perpendicular to the striking face 65, such that they can correct mishits by pushing a golf ball towards the center of the striking face 65. Angling the carbon rods 62 also creates top spin. The ideal angle for the carbon rods 62 with respect to the plane 66 is 45°, though this angle may, in other embodiments, vary across the face insert 60 to improve striking characteristics depending on the location of the striking face 65 at which a ball makes contact.

Figure 8:
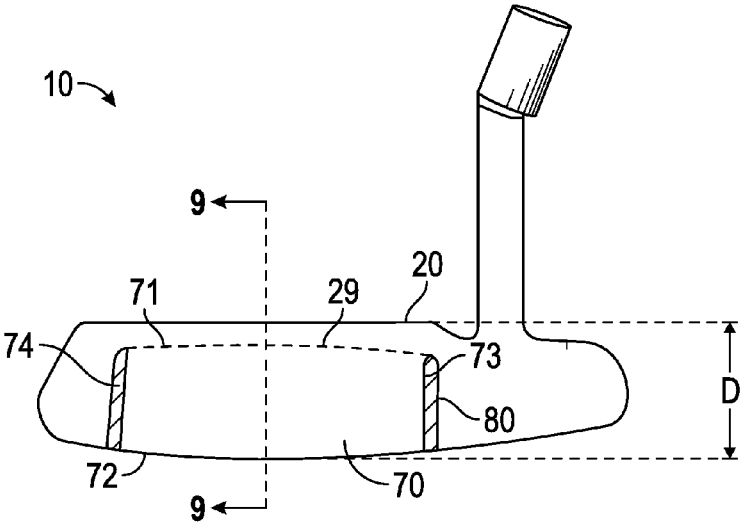
FIG. 8 is a front plan view of a putter head with a face according to a fifth embodiment of the present invention.
Figure 9:
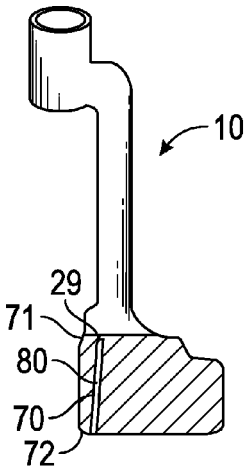
FIG. 9 is a cross-sectional view of the putter head shown in FIG. 8 along lines 9-9.

As shown in FIGS. 8-9, in a fifth embodiment of the present invention, the putter head 10 has a body 20 with the same features disclosed in connection with the first embodiment herein, and a face component 70 that preferably is integrally formed with the body 20 but, in alternative embodiments, may be formed separately and then affixed to the body 20 at a hinge location 29. In this embodiment, the face component 70 comprises a top side 71, a bottom side 72, a heel side 73, and a toe side 74, and may include any of the features disclosed herein with respect to other embodiments. The face component 70 is affixed to the body 20 only along one side, and preferably along its top side 71, at the hinge location 29 on the body 20. This construction creates a deep slot 80 that extends more than halfway through the depth D of the body 20, which reduces back spin without affecting launch angle. In this embodiment, the deep slot 80 preferably is at least partially filled with a soft, polymeric material such as urethane or a foam material to prevent debris from becoming wedged therein.

Figure 10:
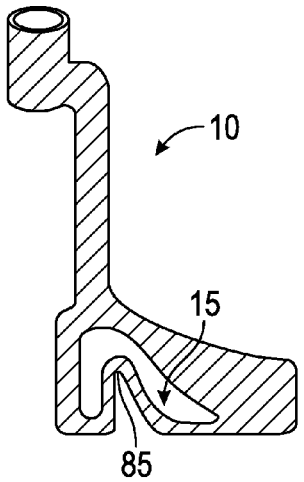
FIG. 10 is a cross-sectional view of a putter head with a sole channel according to a sixth embodiment of the present invention.

A sixth, similar embodiment is shown in FIG. 10. In this embodiment, the putter head 10 comprises an interior cavity 15, which preferably is left empty but may, in an alternative embodiment, be at least partially filled with a lightweight material such as foam, and a deep sole channel 85 proximate the face that extends into the interior cavity 15. In this embodiment, the putter head 10 preferably is composed of a metal material, such as stainless steel, and the deep sole channel 85 may be formed using any of the techniques and constructions disclosed in U.S. Pat. Nos. 8,403,771 and 8,529,368 or U.S. Patent Application Publication Nos. 2013/0165252 and 2013/0165254, the disclosure of each of which is hereby incorporated by reference in its entirety herein.

Figure 11:
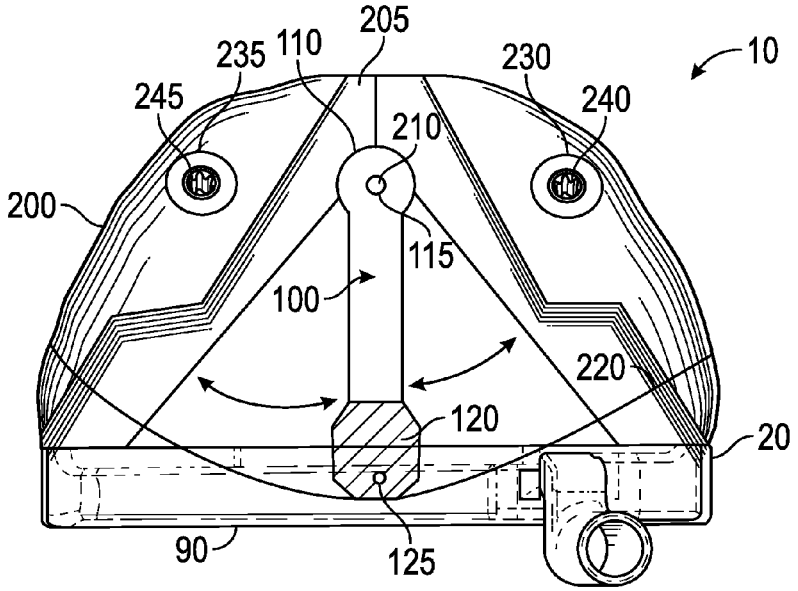
FIG. 11 is a top plan, partially transparent view of a putter head with an adjustable weight cartridge according to a seventh embodiment of the present invention.
Figure 12:
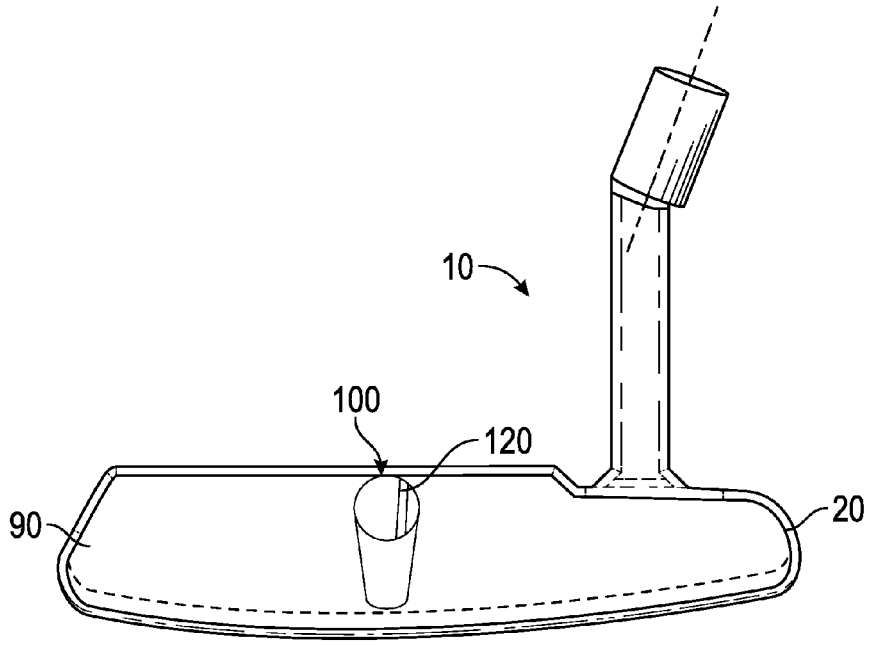
FIG. 12 is a front plan, partially transparent view of the putter head shown in FIG. 11.
Figure 13:
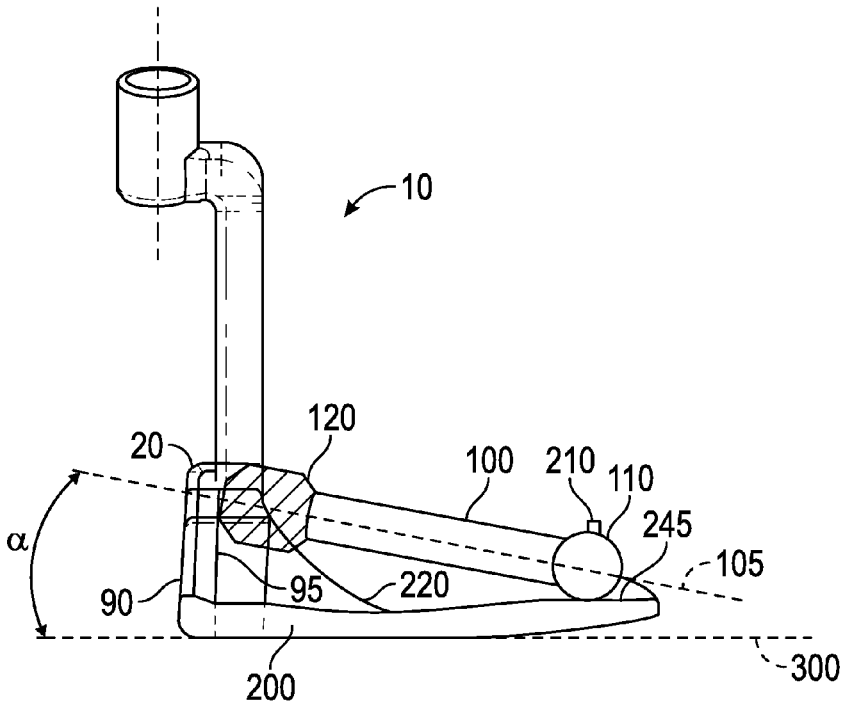
FIG. 13 is a side plan, partially transparent view of the putter head shown in FIG. 11.

A seventh embodiment of the present invention is shown in FIGS. 11-13. This embodiment may be used in combination with any of the other embodiments disclosed herein to further enhance putter performance. In this embodiment, the putter head 10 comprises a body 20 with the same features disclosed in connection with other embodiments disclosed herein, except that its bottom portion 200 extends at least one inch, and preferably at least two inches, rearward of the face 90, which preferably is integrally formed with the body 20 but may, in other embodiments, be a face insert. The bottom portion 200 of the putter head 10 includes an upper surface at a rear portion 205 of the bottom portion 200 with a pin 210 extending approximately vertically therefrom, and a support structure 220 extending approximately parallel with the face 90 for at least a portion of the face 90 and then curving backwards from the face 90. The bottom 200 also includes a plurality of weight ports 230, 235 sized to receive one or more weight screws 240, 245.

The embodiment shown in FIGS. 11-13 also includes an adjustable weight cartridge 100, which may include any of the features disclosed in U.S. patent application Ser. Nos. 13/797,404, 13/906,572, 14/039,102, 14/159,262, 14/163,216, 14/173,615, and 14/180,795, the disclosure of each of which is hereby incorporated by reference in its entirety herein. The adjustable weight cartridge 100 comprises a lightweight end 110 and a heavy end 120, each with a through hole 115, 125 sized to receive the pin 210 and permit the adjustable weight cartridge 100 to pivot around the pin 210 in a heel-to-toe direction, as shown in FIG. 11, thus adjusting the heel-to-toe location of the putter head 10 center of gravity.

The adjustable weight cartridge 100 has a longitudinal axis 105 that preferably has an angle $\alpha$ with respect to a ground plane 300, as shown in FIG. 13, and is capable of making contact with a back surface 95 of the face 90 at one or more locations on the back surface 95. The adjustable weight cartridge 100 may also make contact with one or more portions of the support structure 220. The adjustable weight cartridge 100 can be flipped so that one of the ends 110, 120 is proximate the face 90, thus adjusting the front-to-back location of the putter head 10 center of gravity, and, to some extent, the vertical location of the putter head 10 center of gravity. These adjustments to the center of gravity also affect other mass properties and can affect the spin imparted to a golf ball by the putter head 10.

Figure 14:
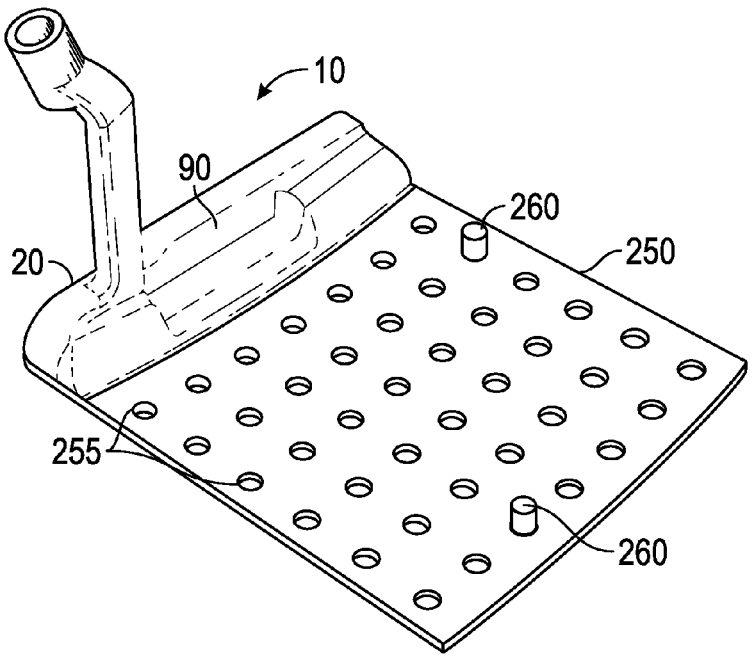
FIG. 14 is a rear perspective view of a putter head according to an eighth embodiment of the present invention.

The eighth embodiment of the present invention, shown in FIG. 14, may also be used in combination with any of the other embodiments disclosed herein to further enhance putter performance. In this embodiment, the putter head 10 comprises a body 20 with the same features disclosed in connection with other embodiments disclosed herein, except that it includes a lengthy plate portion 250 that extends at least one inch, and preferably more than two inches, rearwards away from the face 90, which preferably is integrally formed with the body 20 but may, in other embodiments, be a face insert. The plate portion 250 comprises a plurality of through holes 255 that are sized to receive one or more removable weights 260 so that a golfer may fine tune the location of the putter head's 10 center of gravity and other mass properties of the putter head 10.

Each of the putter heads 10, or portions thereof, disclosed herein may be formed by casting, injection molding, forging, extruding, machining, and composite molding. Composites and low density materials are particularly useful to achieve particular center of gravity locations for a putter head 10, and any of the putter heads 10 disclosed herein can be formed of a carbon material truss system, which permits the use of two high density materials in different locations.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A putter head comprising:

a body comprising a top portion, a bottom portion, a heel side, a toe side, and a hosel;

a face component comprising a striking surface and a variable thickness pattern; and at least one adjustable weight feature affixed to the body, wherein the variable thickness pattern comprises a plurality of circles disposed on the striking surface, wherein spacing between each pair of adjacent circles of the plurality of circles at a location on the striking surface proximate the top portion is greater than spacing between each pair of adjacent circles of the plurality of circles at a location on the striking surface proximate the bottom portion, wherein a distance between the plurality of circles on the striking surface gradually decreases in a direction from proximate the top portion to proximate the bottom portion and wherein each of the plurality of circles is an indentation extending into the striking surface.

2. A putter head comprising:

a body comprising a top portion, a bottom portion, a heel side, a toe side, and a hosel;

a face component comprising a striking surface and a variable thickness pattern; and at least one adjustable weight feature, wherein the bottom portion extends rearwards away from the striking surface, wherein the bottom portion comprises a plurality of through holes, wherein the variable thickness pattern comprises a plurality of geometric shapes disposed on the striking surface, wherein spacing between each pair of adjacent geometric shapes of the plurality of geometric shapes at a location on the striking surface proximate the top portion is greater than spacing between each pair of adjacent geometric shapes of the plurality of geometric shapes at a location on the striking surface proximate the bottom portion wherein a distance between the plurality of geometric shapes on the striking surface gradually decreases in a direction from proximate the top portion to proximate the bottom portion, wherein the at least one adjustable weight feature comprises a plurality of weight screws, and wherein each of the plurality of weight screws is sized to at least partially fit within at least one of the plurality of through holes.

3. The putter of claim 2, wherein the plurality of through holes comprises at least ten through holes.

4. The putter of claim 2, wherein the bottom portion is at least partially composed of a metal material, and wherein the through holes are evenly spaced from one another across the bottom portion.

* * * * *